United States Patent [19]

Milano et al.

[11] Patent Number: 4,731,905

[45] Date of Patent: Mar. 22, 1988

[54] OVERHEAD DOOR TORSION SPRING ASSEMBLY AND METHOD

[75] Inventors: Richard J. Milano; Coy H. Burgess; William F. Wadsworth, all of Dixon, Ill.

[73] Assignee: Raynor Manufacturing Company, Dixon, Ill.

[21] Appl. No.: 858,583

[22] Filed: May 1, 1986

[51] Int. Cl.[4] ..... E05F 1/08

[52] U.S. Cl. ..... 16/306; 16/DIG. 1; 16/DIG. 42; 160/191; 49/200

[58] Field of Search ..... 16/198, 255, 256, 299, 16/300, 306, 308, DIG. 1, DIG. 42; 267/155, 57, 58; 160/191; 49/200

[56] References Cited

U.S. PATENT DOCUMENTS 1,078,780 11/1913 Forsyth ..... 16/198

2,453,424 11/1948 Foster ..... 16/198

2,932,057 4/1960 Pemberton ..... 16/198

*Primary Examiner*—Nicholas P. Godici

*Assistant Examiner*—G. M. Reid

*Attorney, Agent, or Firm*—Tilton, Fallon, Lungmus

[57] ABSTRACT

A torsion spring assembly for counterbalancing overhead doors which includes an elongated helical torsion spring with coils that are normally spaced apart (when the spring is untensioned), a shaft extending through the spring, and a pair of spring-mounting collars carried by the shaft and provided with slotted neck portions operatively connected to pre-formed hooks at the ends of the spring. One of the collars is fixed against both rotational and axial movement upon the shaft; the other is rotatably mounted upon the shaft; and at least one of the collars is removable from the shaft for field disassembly and reassembly of the parts. The method for constructing the assembly, either during manufacture or in the field, is also disclosed.

13 Claims, 9 Drawing Figures

10
12
13
13a
13b
14
14a
14b
15
15a
15b
15c
15d
16
17
18
19
20
21
22
23
24
25
26
27
28
29
30
31
32
33
34
35
36

OVERHEAD DOOR TORSION SPRING ASSEMBLY AND METHOD

BACKGROUND AND SUMMARY OF THE INVENTION

Overhead doors or curtains are commonly counterbalanced by torsion spring assemblies, such an assembly generally including a support shaft which extends through the spring and is not only anchored to one end of the spring but is also adjustably fixed to a frame that in turn is mounted upon the building structure. The opposite end of the spring is connected to a tubular barrel that covers the spring and provides the means for supporting the hinged panel door or curtain. Selected tension is imparted to the spring and is transmitted by the barrel to counterbalance or compensate for the weight of the door.

It is also well known that replacement of such a spring in the field can be difficult and, in some cases, even dangerous. The difficulty frequently centers on the steps of properly forming the ends of such a spring and then securely connecting them to the anchoring sleeves while simultaneously stretching the spring to space its coils apart, thereby allowing space for additional coils to be formed later as the spring is twisted to perform its counterbalancing function. (Typically, such a spring is wound with no gaps or spaces between its coils when the spring is a free or untensioned state.) The "forming" operation commonly includes heating each end of the spring with a torch or other suitable means to a cherry red condition so that the wire can be bent or securely connected to each anchoring collar. Such an operation requires substantial time and special equipment during manfacture and is especially difficult to carry out in the field when a broken spring is to be replaced. Also, depending on the amount of heat applied to the wire during bending, the physical properties of the spring material may be adversely affected, increasing the risks of premature spring breakage.

Unlike a conventional counterbalance spring, the torsion spring of this invention is formed with spaces between its coils and is compressed rather than stretched during assembly with the other parts. The spring includes pre-formed radially-extending hook portions at its opposite ends which are received in slots provided in reduced neck portions of the spring-mounting collars. During assembly, the spring is fitted onto a shaft which has one of the collars already mounted at its distal end, the hook at the distal end of the spring is inserted into the slot of the collar, the spring is then compressed, and the second collar is mounted upon the shaft at a distance from the first collar only slightly less than the length of the spring in an untensioned state. The compressive forces applied to the spring are then released and the hook portion at the spring's proximal end is inserted into the slot of the second anchoring collar.

Such a construction allows the torsion spring assembly to be quickly, easily, and safely assembled in the field or during manufacture. Of particular importance during field assembly is the fact that no specially-designed tools are required for spring replacement and no on-site heating and forming steps are performed. These and other important advantages, features, and objects of the invention will become apparent from the following specification and drawings.

DRAWINGS

DETAILED DESCRIPTION OF PREFERRED EMBODIMENT

Figures 1, 2, 3:
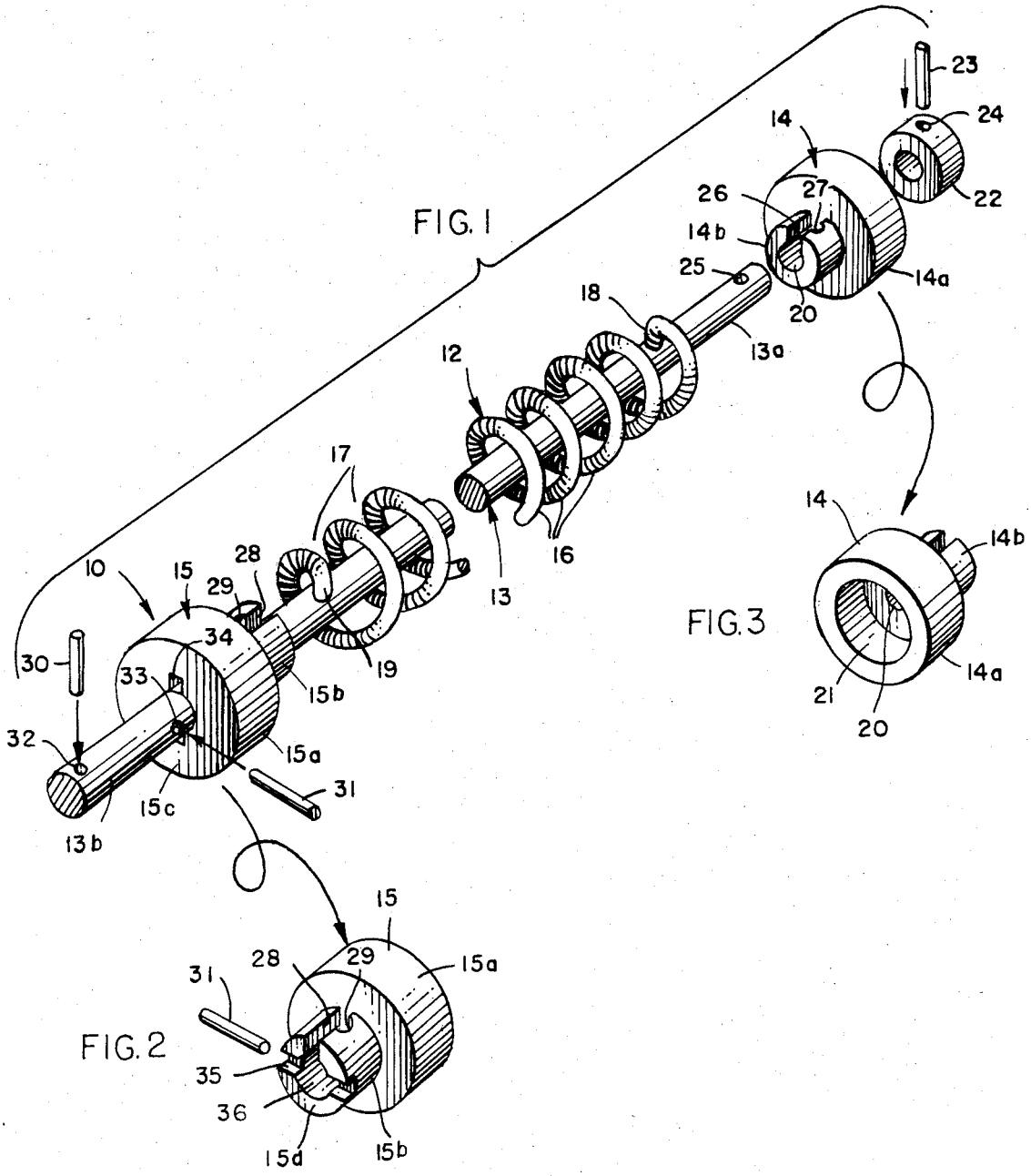
FIG. 1 is an exploded perspective view of a torsion spring assembly embodying the present invention.
FIG. 2 is a perspective view showing one of the spring-mounting collars reversed end-to-end.
FIG. 3 is a perspective view depicting the other of the spring-mounting collars reversed end-to-end.

Referring to the drawings, and particularly to FIGS. 1–3 and 9, the numeral 10 generally designates a torsion spring assembly for counterbalancing an overhead door or curtain of the type composed of a multiplicity of hinged panels or slats. The term "overhead door" is used generically here to mean a closure composed of segments hinged along their horizontal edges whether such segments take the form of panels or narrow slats. The term therefore encompasses overhead "curtain" constructions as that word is commonly used in the industry. As is well known in this field, the door would be connected along its upper margin to a tubular barrel 11 depicted in phantom in FIG. 9. Since the barrel and door may be entirely conventional and are not part of the specific assembly of this invention, detailed discussion of these elements is believed unnecessary herein.

Assembly 10 comprises an elongated helical torsion spring 12, an elongated cylindrical shaft 13, a pair of spring-mounting collars 14 and 15 for supporting the ends of the spring upon the shaft, and means for retaining the collars in position upon the ends of the shaft.

Figure 9:
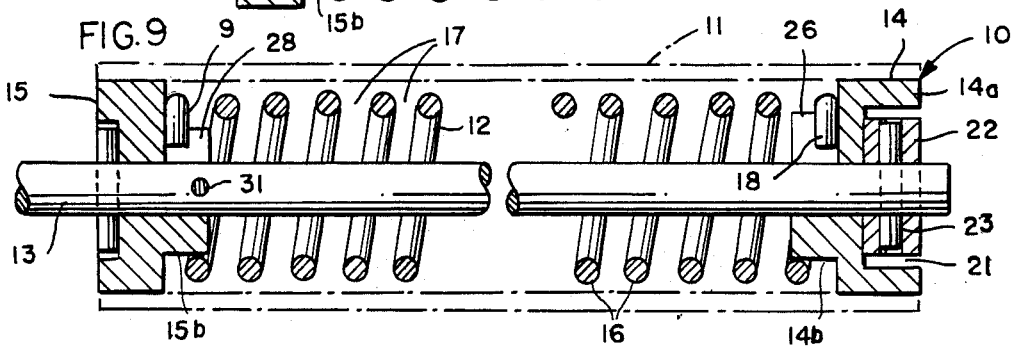
FIG. 9 is a longitudinal sectional view illustrating the completed torsion spring assembly of this invention.

The spring 12 is shown in FIGS. 1 and 9 in a generally untensioned and uncompressed (or only slightly compressed) condition. In that condition, its multiplicity of coils 16 are spaced apart with gaps or spaces 17 therebetween. At each of its ends, the spring is provided with radially inwardly-turned pre-formed hook portions 18 and 19. The term "pre-formed" is used herein to mean that such hook portions are formed during spring manufacture under precisely controlled conditions and, in particular, are not formed during the procedure of assembling the spring with the other parts shown in the drawings. Such radially-projecting hook portions or stubs 18, 19 are of limited radial extent. Specifically, the radial dimension of each hook portion is no greater than, and preferably less than, the difference between the outer diameters of spring 12 and shaft 13. Also, as shown most clearly in FIG. 1, each inwardly-projecting hook portion is an integral extension of the wire material from which the spring is formed.

The first spring-mounting collar 14 may be referred to as a rotating collar because it is rotatably mounted upon shaft 13. As depicted in FIGS. 1, 3, and 9, collar 14 has an enlarged cylindrical body portion **14*a* and a reduced integral neck portion 14*b*. A bore 20 extends through the neck and body portions for rotatably receiving one end portion 13*a* of shaft 13. In the embodiment illustrated, the enlarged body of the collar 14 is provided with an outwardly-facing cylindrical chamber or recess 21. That chamber receives a locking ring 22 that is secured to end portion 13***a* of the shaft by a drive pin 23 which extends through aligned transverse bores 24 and 25 in the ring and shaft, respectively. Such a construction is particularly advantageous because, although the drive pin 23 is preferably retained frictionally in transverse openings or bores 24, 25, should such frictional forces be insufficient to insure retention, the pin is nevertheless unable to escape because the locking ring 22 is disposed within chamber 21.

Neck portion 14*b*, formed as an integral part of the collar 14, is provided with a longitudinal or axial slot 26 that extends the full length and radial thickness of the neck portion and has a width only slightly greater than the width or transverse dimension of hook portion 18. However, at a point intermediate the length of the slot, one of the walls defining that slot (the wall that faces the inner side of hook 18 when the parts are assembled) is provided with a semi-cylindrical and radially-extending depression or recess 27 for receiving and securely retaining the hook portion 18 when the spring is tensioned or twisted during installation and use.

The second collar 15 is similarly provided with a body portion 15*a* and a reduced integral neck portion 15*b*. In general configuration the collar 15 is similar to collar 14 except for the omission of chamber 21. Like the first collar, the second collar 15 has its neck portion 15*b* provided with an axially extending slot 28, one wall of which has a radially-extending semi-cylindrical recess 29 for receiving and retaining hook portion 19 at the opposite end of spring 12.

The second collar is fixed to end portion 13*b* against axial movement (in both directions) and rotational movement upon shaft 13. The means for locking the collar 15 and shaft 13 together takes the form of a pair of drive pins 30 and 31 which extend through transverse bores or openings 32 and 33, respectively, in shaft 13. It will be observed that pin 30 has a length greater than the diameter of shaft 13 but less than the outside diameter of body portion 15*a* of collar 15. Diametrically-disposed recesses 34 are formed in the outer face 15*c* of collar 15 to receive the ends of pin 30. Although the pin is frictionally received within its bore 32, additional security against the possibility of unintended pin release is therefore achieved because the pin is captured within the slots or recesses 34 formed in the outer face of the second collar.

Similar slots or recesses 35 are formed in the inwardly-facing surface 15*d* of neck portion 15*b*. Such diametrically aligned slots extend from the central bore 36 of the collar 15 to the outer cylindrical surface of neck portion 15*b* and accommodate the ends of pin 31 that is frictionally retained in transverse bore 33 of the shaft when the parts are assembled. Pins 30 and 31 thereby lock collar 15 against both rotational and axial movement upon the shaft.

Figure 4:
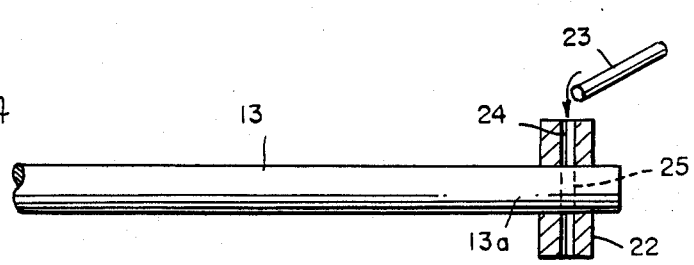
FIG. 4 is a fragmentary side elevational view, taken partly in section, showing an initial step in constructing the assembly of this invention.
Figure 5:
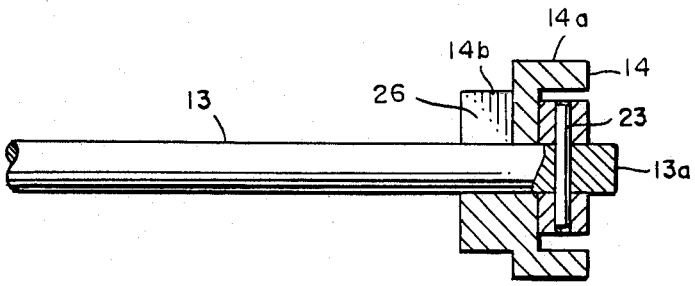
FIGS. 5–8 are fragmentary views similar to FIG. 4 but illustrating subsequent steps in forming the assembly.
Figure 6:
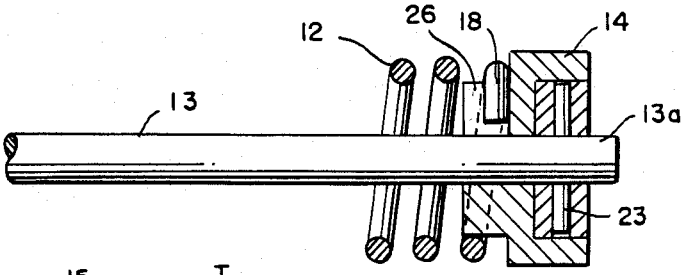

As a first step in forming the assembly, locking ring 22 is fitted upon shaft 13 and is fixed in place by drive pin 23 (FIG. 4). The rotatable first collar 14 is then slipped onto the shaft and is slid to the distal end 13*a* upon which the locking ring has been mounted (FIG. 5). The helical torsion spring is then fitted over the shaft until its hook portion 18 is received within the axially-extending slot 26 in the neck portion 14*b* of collar 14.

Figure 7:
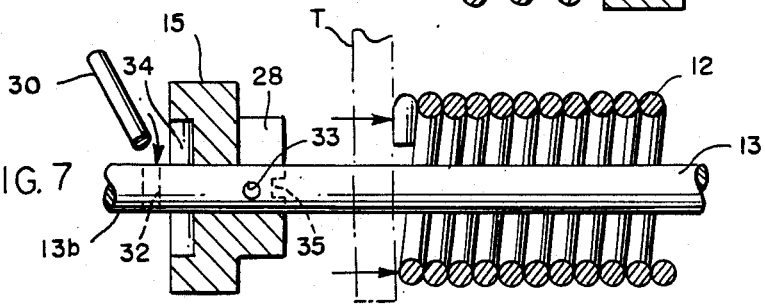
Figure 8:
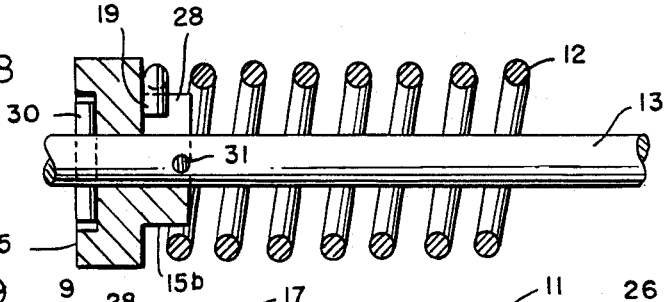

Spring 12, which heretofore has remained in a free or untensioned state, is now compressed by applying compressive force to its proximal end as schematically depicted in FIG. 7. The compressive force may be applied by any suitable tool T—vice-grip pliers have been found particularly suitable for the purpose because they are useful not only in applying the compressive force but later in holding the spring in its fully compressed condition with its coils in abutting or contiguous relation (FIG. 7). In performing this latter function, the jaws of the pliers T may be clamped against shaft 13 to retain the spring in its fully compressed state. With the spring so compressed, the user simply slips the second collar 15 onto the proximal end 13*b* of the shaft and locks it in place by first inserting drive pin 30 and then, after urging the collar outwardly until the ends of the pin are fully received within slots 34, inserting the second drive pin 31 (FIG. 7). The tool T is then removed and the spring 12 is allowed to expand with its hook portion 19 being directed into slot 28 in neck portion 15*b* of the collar (FIG. 8).

The parts as fully assembled therefore assume the relationship shown in FIG. 9. Spring 12 is uncompressed, or only slightly compressed, with its coils 16 spaced apart as shown. The relationship is such that the distance between collars 14 and 15—that is, the distance between the inner faces of neck portions 14*b* and 15*b*—is less than the length of the spring in a completely untensioned state. However, that distance is also substantially greater than the length of the spring when it is fully compressed. Therefore, by simply compressing the spring and temporarily retaining it in compressed condition during assembly, the second collar 15 may be easily and quickly mounted upon shaft 13.

Since spring 12 is not in a stretched state when the parts are assembled as shown in FIG. 9, the spring does not inherently exert forces tending to draw hook portions 18 and 19 out of slots 20 and 28. During operation of the assembly, when twisting forces are exerted upon the spring to increase its number of coils (and simultaneously reduce its diameter), and when such forces are relieved by reverse movement of the door, any tendency for hook portions 18 and 19 to walk out of slots 20 and 28 is effectively prevented by recesses 27 and 29 which receive and securely retain the hook portions of the spring.

In describing collars 14 and 15, the terms "first" and "second" have been used to distinguish one collar from the other. Those terms do not necessarily reflect the order of mounting the collars on shaft 13. Thus, the sequence described above might be reversed, with collar 15 being first mounted upon the shaft, followed by mounting and compressing of the spring, and then by mounting of collar 14 and locking ring 22. In either case, the spring is compressed axially prior to mounting the last collar upon the shaft and, after that collar is so mounted, the compressive forces are removed to allow the spring to expand and permit its hook portion to enter the slot of the neck portion of the second-mounted collar.

While in the foregoing, an embodiment of the invention has been disclosed in considerable detail for purposes of illustration, it will be understood by those skilled in the art that many of these details may be varied without departing from the spirit and scope of the invention.

We claim:

1. A torsion spring assembly for overhead doors, comprising an elongated helical torsion spring having a multiplicity of coils which are normally spaced apart when said spring is in an untensioned state; said spring having radially inwardly turned hook portions at opposite ends thereof; a shaft extending through the coils of said spring having end portions projecting beyond said spring; a first spring-mounting collar having a bore rotatably receiving one of said end portions of said shaft; said first collar having a neck portion extending into the coils at one end of said spring; said neck portion of said first collar having a generally axially-extending slot receiving one of said hook portions of said spring for anchoring said one end of said spring and said first collar against independent relative rotation; means secured to said shaft for preventing outward axial movement of said first collar upon said shaft; a second spring-mounting collar having a bore receiving the other end of said shaft; said second collar having a neck portion extending into the coils at the other end of said spring opposite from said one end; said neck portion of said second collar having a generally axially extending slot receiving the other of said hook portions of said spring for anchoring said other end of said spring and said second collar against independent relative rotation; and removable locking means securing said second collar against independent axial and rotational movement relative to said ahaft; opposing ends of said neck portions of said first and second collars is such that the spring would be in a partially compressed state when said spring is fully untensioned.

2. The assembly of claim 1 in which each of said neck portions includes a radially-extending recess within the slot thereof for receiving and retaining said hook portions of said spring.

3. The assembly of claims 1 or 2 in which each of said neck portions of said first and second collars is of reduced diameter with respect to the remainder of each of said collars.

4. The assembly of claims 1 or 2 in which said means for preventing outward axial movement of said first collar includes a locking ring affixed to said one end portion of said shaft and providing a bearing surface rotatably engaging an outwardly-facing surface of said first collar.

5. The assembly of claim 4 in which said locking ring is affixed to said shaft by a removable drive pin; said drive pin extending through aligned transverse bores in said locking ring and said one end portion of said shaft.

6. The assembly of claims 1 or 2 in which said removable locking means comprises a pair of drive pins extending transversely through said other end portion of said shaft adjacent opposite ends of said second collar; said second collar having openings therein for receiving said pair of pins and securing said second collar against axial and rotational movement relative to said shaft.

7. The asssembly of claim 1 in which the length of said spring when fully compressed with adjacent coils thereof in contiguous relation is substantially less than the distance between the opposing ends of said neck portions of said first and second collars.

8. The assembly of claim 2 in which the length of said spring in an untensioned state is equal to the distance between said radially-extending recesses of said neck portions of said first and second collars.

9. The assembly of claims 1 or 2 in which said spring is formed of wire and said hook portions are integral radially-extending portions of said wire; said hook portions each having a length no greater than the diameter of said shaft and the outside diameter of said spring.

10. The assembly of claim 2 in which each of said radially-extending recesses is generallly semi-cylindrical in shape.

11. A torsion spring assembly for overhead doors, comprising an elongated helical torsion spring having a multiplicity of coils which are normally spaced apart when said spring is in an untensioned state; said spring having radially inwardly turned hook portions at opposite ends thereof; a shaft extending through the coils of said spring having end portions projecting beyond said spring; a first spring-mounting collar having a bore rotatably receiving one of said end portions of said shaft; said first collar having a neck portion extending into the coils at one end of said spring; said neck portion of said first collar having a generally axially-extending slot receiving one of said hook portions of said spring for anchoring said one end of said spring and said first collar against independent relative rotation; means secured to said shaft for preventing outward axial movememt of said first collar upon said shaft; a second spring-mounting collar having a bore receiving the other end of said shaft; said second collar having a neck portion extending into the coils at the other end of said spring opposite from said one end; said neck portion of said second collar having a generally axially extending slot receiving the othe of said hook portions of said spring for anchoring said other end of said spring and said second collar against independent relative rotation; and removable locking means securing said second collar against independent axial and rotational movement relative to said shaft; said means for preventing outward axial movement of said first collar including a locking ring affixed to said one end portion of said shaft and providing a bearing surface for rotatably engaging an outwardly facing surface of said first collar; said locking ring being affixed to said shaft by a removable drive pin; said drive pin extending through aligned transverse bores in said locking ring and said one end portion of said shaft; said first collar including a cylindrical chamber receiving said locking ring; said chamber preventing removal of said drive pin when said locking ring is received therein.

12. A method of constructing a torsion spring assembly for counterbalancing an overhead door, comprising the steps of forming an elongated helical torsion spring with a multiplicity of coils that are normally spaced apart when said spring is in an untensioned state, said spring having radially-inwardly turned hook portions at opposite ends thereof; fitting said spring upon a shaft having a length greater than said spring, said shaft having a collar mounted at one end thereof with an inwardly-facing neck portion having an axial slot; said fitting step including inserting the hook portion at the distal end of said spring into the slot of said neck portion to interlock the same against independent relative rotation; then axially compressing said spring to position the coils thereof in substantially contiguous relation; then, while said spring is so compressed, mounting a second collar upon the opposite end of said shaft at a distance from said first collar exceeding the length of said spring in its compressed state but less than the length of said spring in an untensioned state; said step of mounting said second collar including fixing the same against axial movement in opposite directions upon said shaft, said second collar including a neck portion facing said spring having an axial slot adapted to receive the hook portion of said spring at the proximal end thereof; and thereafter removing the compressive forces from said spring, to allow the same to expand, while directing said hook portion at said proximal end into the slot of said neck portion of said second collar; one of said first and second collars being secured against rotation relative to said shaft and the other of said collars being freely rotatable upon said shaft.

13. The method of claim 12 in which said neck portion of each of said first and second collars is provided with a radially-extending recess communicating with said slot and adapted to receive the hook portion at one end of said spring; said fitting and directing steps including guiding the hook portions at opposite ends of said spring into said radially recesses of said neck portions.

* * * * *